US008229131B2

(12) United States Patent
Plocher et al.

(10) Patent No.: US 8,229,131 B2
(45) **Date of Patent: *Jul. 24, 2012**

(54) SYSTEMS AND METHODS FOR DELIVERING DIRECTIONAL AUDIO AND PERSONALIZED EMERGENCY ALERTS VIA ADDRESSABLE SPEAKERS

(75) Inventors: Thomas A. Plocher, Hugo, MN (US); Andrew G. Berezowski, Wallingford, CT (US); Walter L. Heimerdinger, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 1079 days.

This patent is subject to a terminal disclaimer.

(21) Appl. No.: 11/867,182

(22) Filed: Oct. 4, 2007

(65) Prior Publication Data

US 2009/0092263 A1 Apr. 9, 2009

(51) Int. Cl.

| | |
|---|---|
| ***H04R 27/00*** | (2006.01) |
| ***G08B 29/00*** | (2006.01) |
| ***G08B 25/08*** | (2006.01) |

(52) U.S. Cl. ..... 381/82; 340/506; 340/692

(58) Field of Classification Search ..... 381/82; 340/692, 628, 331, 332

See application file for complete search history.

(56) References Cited

U.S. PATENT DOCUMENTS

| | | | | |
|---|---|---|---|---|
| 5,406,634 | A | 4/1995 | Anderson et al. | |
| 6,201,470 | B1 | 3/2001 | Withington | |
| 6,518,878 | B1 | 2/2003 | Skoff | |
| 6,829,513 | B2 | 12/2004 | Piersanti et al. | |
| 7,148,810 | B2 * | 12/2006 | Bhat | 340/692 |
| 7,218,238 | B2 * | 5/2007 | Right et al. | 340/628 |
| 7,259,656 | B1 * | 8/2007 | Wright | 340/286.14 |
| 7,629,894 | B2 * | 12/2009 | Plocher et al. | 340/692 |
| 2003/0128850 | A1 * | 7/2003 | Kimura et al. | 381/82 |
| 2005/0105743 | A1 * | 5/2005 | Faltesek et al. | 381/82 |
| 2005/0128070 | A1 | 6/2005 | Faltesek et al. | |

FOREIGN PATENT DOCUMENTS

| | | | |
|---|---|---|---|
| DE | 10 2005 021 736 | A1 | 11/2006 |
| EP | 0210365 | | 2/1987 |
| GB | 2123193 | | 1/1984 |
| GB | 2198269 | | 11/1986 |
| GB | 2278216 | | 5/1993 |
| GB | 2362739 | A | 11/2001 |
| WO | WO 96/25729 | | 5/1996 |
| WO | WO 9625729 | A1 * | 8/1996 |

(Continued)

OTHER PUBLICATIONS

PCT International Search Report corresponding to International Application No. PCT/US 08/76117 mailed Nov. 24, 2008.

(Continued)

*Primary Examiner* — Hai Phan
*Assistant Examiner* — David Ton
(74) *Attorney, Agent, or Firm* — Husch Blackwell LLP

(57) ABSTRACT

A public address system installed in a building or other region being monitored can communicate with a regional fire detection system. Responsive to information received from the fire detection system as to developing dangerous conditions, a control unit for the public address system can adaptively create one or more evacuation routes for a region associated with a developing condition. One or more loud speakers in the region can be used to communicate a preferred evacuation route to individuals in the region. The route can be dynamically altered as the condition varies over time.

24 Claims, 5 Drawing Sheets

FOREIGN PATENT DOCUMENTS

WO WO2006137805 A1 6/2005

OTHER PUBLICATIONS

Written Opinion of the International Searching Authority corresponding to International Application No. PCT/US 08/76117 mailed Nov. 24, 2008.

Guylene Proulx and Jonathan D. Sime, To Prevent 'Panic' in an Underground Emergency: Why Not Tell People the Truth?, Fire Safety Science—Proc. 3rd Int. Symp., 1991, 843-852.

Supplementary European Search Report corresponding to Application No. EP 08 83 6545 dated Aug. 18, 2011.

* cited by examiner

ADDRESSABLE SPEAKER BLOCK DIAGRAM

ADDRESSABLE SPEAKER
TYPE 1 CONNECTION TO PANEL- COMMON WIRING WITH ADDRESS

ADDRESSABLE SPEAKER
TYPE 2 CONNECTION TO PANEL- ADDRESSING BY MEANS OF AN INDIVIDUAL WIRE TO EACH SPEAKER

SYSTEMS AND METHODS FOR DELIVERING DIRECTIONAL AUDIO AND PERSONALIZED EMERGENCY ALERTS VIA ADDRESSABLE SPEAKERS

FIELD

The invention pertains to systems and methods of providing audio evacuation information from a region in the event of a dangerous condition. More particularly, the invention pertains to such systems and methods where addressable loudspeakers might be installed throughout a region being monitored.

BACKGROUND

Oftentimes during an emergency evacuation of a building, occupants must make their own assessment of the relative safety of possible escape or evacuation routes. One must be chosen that is perceived to be safe, and the occupant(s) must find a way to an exit.

Under the stress of such emergency conditions and uncertainty occupants' assessments and choices of safe exit routes may not be the best. Even where the occupant makes a good choice of a route, smoke or darkness may make it difficult to stay on track.

Broadband, directional sound has emerged as an effective means to highlight emergency exit doors and stairwells. It is known to deliver directional sound by using individual sounder devices placed at emergency exit doors and along evacuation routes. Unfortunately, it is still necessary to get the occupants to focus on the existence of an emergency condition and to provide the exit route information.

There is a continuing need to be able to cost effectively get the attention of occupants in a region where an emergency condition is developing or has developed. There is also a continuing need to be able to provide exit information to occupants in the region.

It would also be desirable to be able inject verbal communications into the region of interest. Finally, it would be desirable to make available an output path that reflects conditions in the region as they develop over time.

DETAILED DESCRIPTION

Figure 1:
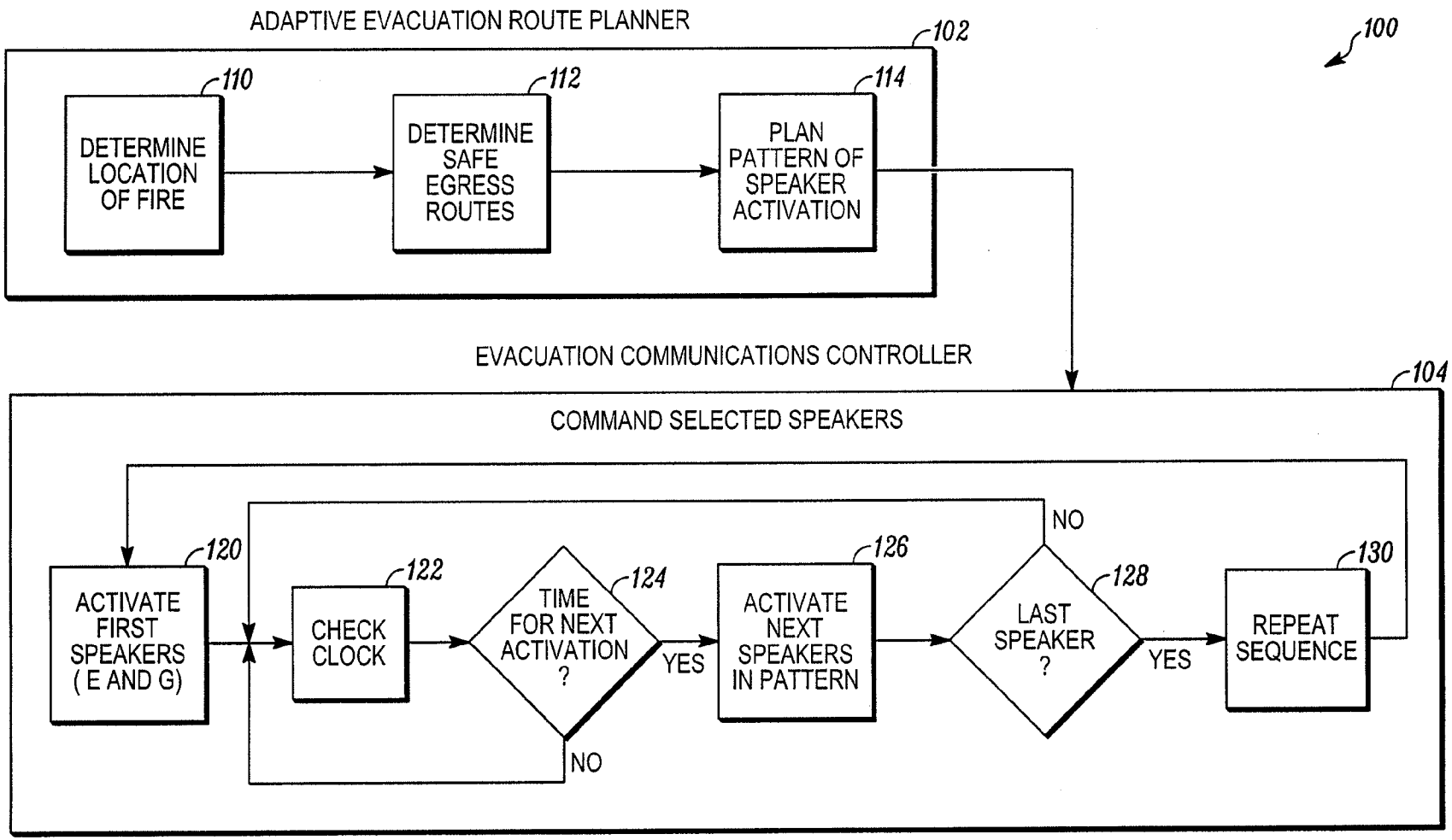
FIG. 1 is a flow diagram of a method in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Methods which embody the invention utilize addressable public address speakers which are installed throughout a region being monitored such as one or more floors of a building. Such addressable speakers can be used, in accordance with a disclosed embodiment to deliver not only general emergency messages but also localized messages that take into account the location of one or more of such speakers relative to a developing dangerous condition.

In another aspect of the invention, such addressable speakers can be used to deliver directional sound and by staggering activation thereof provide route guidance information. For example, speakers can be activated in any pattern deemed effective for communication of an exit route. One exemplary type of activation is sequential. It will be understood that the invention is not limited to sequential-type activation. Further, the high density of public address-type speakers in buildings provides possibilities for extensive and flexible exit routes. Such routes could be different on different floors.

FIG. 1 illustrates aspects of a method 100 in accordance with the present invention. Method 100 includes a planning or route development sequence 102 and an execution sequence 104 wherein a plurality of speakers can be sequentially driven to provide information relative to a preferred exit route.

It will be understood that the invention is not limited to sequentially driving the output devices. Other patterns deemed effective for communicating an exit route come within the spirit and scope of the invention. Further, it will also be understood that different patterns, and or different exit routes can be presented in different regions being monitored. For example, in a multi-story building, one floor might be exhibiting one exit sequence while another floor might be exhibiting a different sequence.

Figure 2:
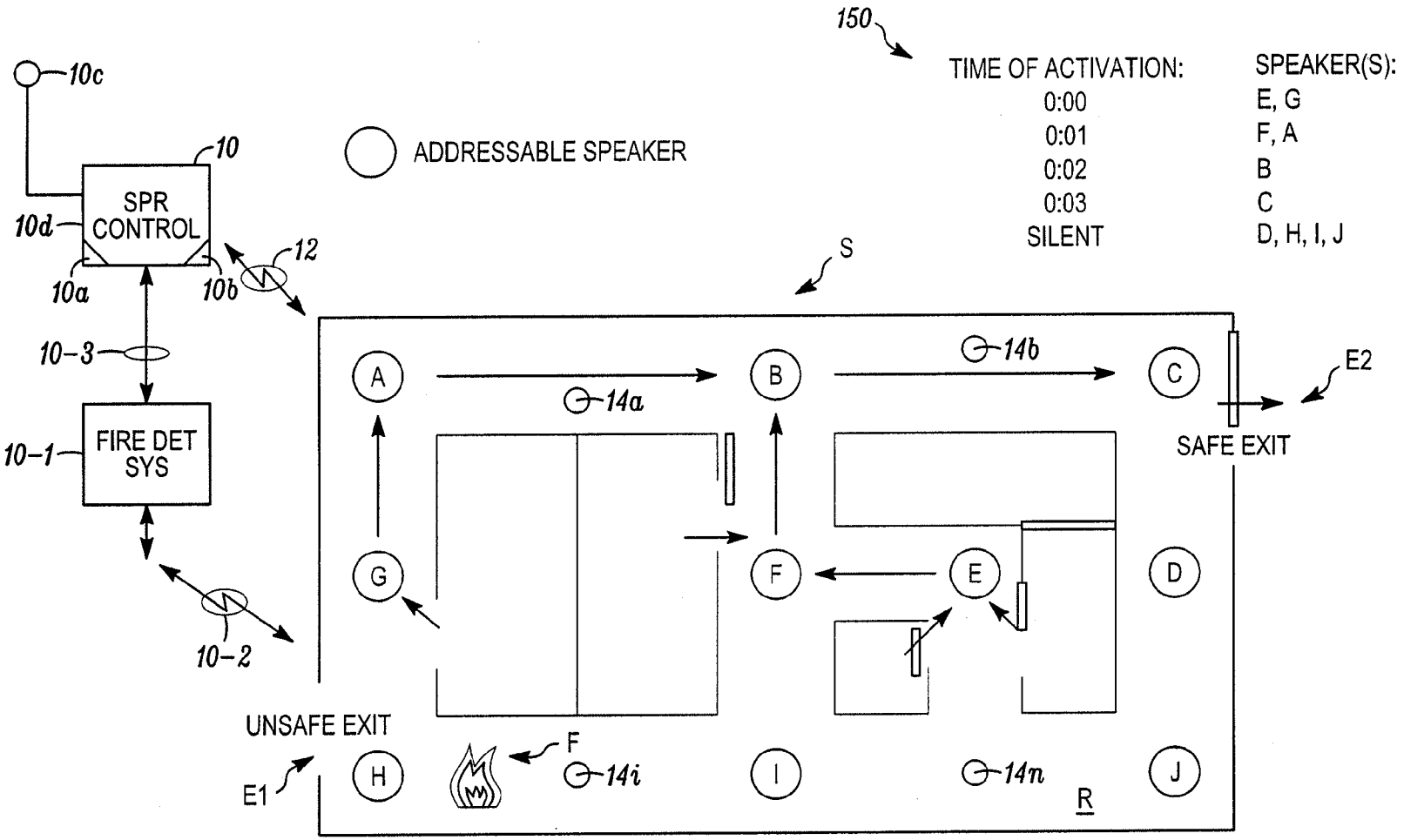
FIG. 2 is top plan view of an exemplary region of interest illustrating results of the method if FIG. 1.

FIG. 2 illustrates a region R, which might be monitored by a fire detecting system. Region R includes a plurality S of addressable loudspeakers, in accordance herewith, a, b, c, d . . . j. A public address or speaker control unit 10 is coupled by a wired and/or wireless medium 12 to members of the plurality S. Control unit 10 can include one or more programmable processors 10*a*, and associated executable control software 10*b* which can implement the method 100 discussed above.

Software 10*b* can be in the form of a product stored on a computer readable medium such as an optical or magnetic disk which can then be loaded into system 10, stored on a computer readable medium therein and then executed by processor 10*a*. Additionally, software 10*b* can be downloaded to system 10 from a displaced source, stored therein on a computer readable medium, such as a disk drive and then executed.

A fire detection system 10-1 can be coupled by a wired or wireless medium 10-2 to a plurality of gas, smoke or fire detectors 14. Detectors 14, such as 14*a, b, c, d, e, f, g, h* and *i* provide feedback signals to system 10-1 indicative of developing fire or other dangerous conditions. Units 10, 10-1 can also be coupled together and communicate via a wired or wireless medium 10-3.

Control unit 10 can also include a microphone 10*c* by which an operator can direct verbal instructions into the region R via members of the plurality S. Manually operable input devices, as well as an associated display device, both indicated generally at 10*d* can be used by the operator in selecting members of the plurality S for activation to provide local verbal outputs for the region R. Alternately, the software 10*b*, in implementing the method 100 can automatically select one or more members of the plurality S for activation. Either verbal outputs or broadband audio signals can be output from members of the plurality S under control of software 10*b*.

FIG. 2 also illustrates a developing fire condition F, adjacent an unsafe exit E1 as well as a relatively safe exit E2 across the floor. In response to sensing the condition F, perhaps with the detectors, such as 14*i* of the fire detection system 10-1, unit 10 can be directed to carry out method 100 to audibly provide a relative safe output route to exit E2.

With respect to FIG. 1, in development sequence 102, a location(s) of a dangerous condition, such as the fire F is first determined, as at 110 for example based on information from detectors 14. One or more safe exit routes can be established as at 112. A pattern of speaker activation can be established as at 114.

In the execution sequence 104 the first speaker or speakers, such as e and g, are activated. Time for the next activation is checked as at 122, 124. The next speaker or speakers in the pattern such as f, a, are activated as at 126.

When the last speaker, such as speaker c has been activated as at 128, the sequence can be repeated as at 130. The preferred time sequential speaker activation pattern 150 is illustrated on FIG. 2. It will be understood that in implementing the sequential pattern 150 software 10*b*, can dynamically vary same in realtime in response to information from system 10-1 as to developing fire conditions, or any other dangerous condition in the region R.

Figure 3:
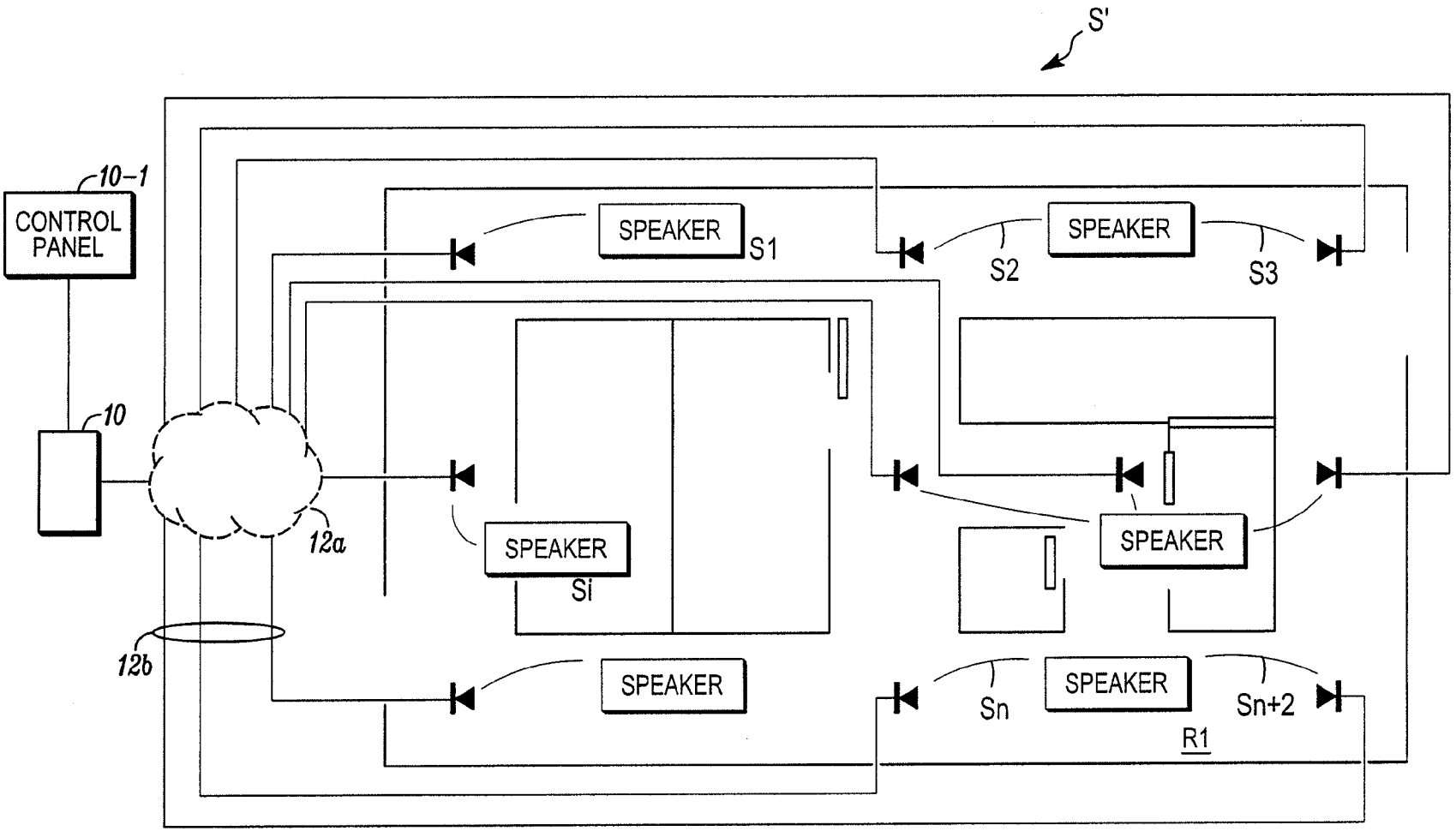
FIG. 3 is a block diagram of an addressable speaker system in accordance with the invention.

FIG. 3 illustrates an addressable speaker configuration in accordance with the present invention installed in a region R 1. A plurality of speakers S' coupled via a computer network 12*a*, which might be implemented as a local area network or an Internet, to a speaker control unit such as the speaker control unit 10. The members of the plurality S' can be coupled to the unit 10 through the computer network 12*a* and local communications path 12*b*. The path 12*b* could be either wired or wireless.

The unit 10, as described above, can implement the method 100 in responsive to information from fire detection system 10-1 and its associated plurality of detectors 14.

Figure 4:
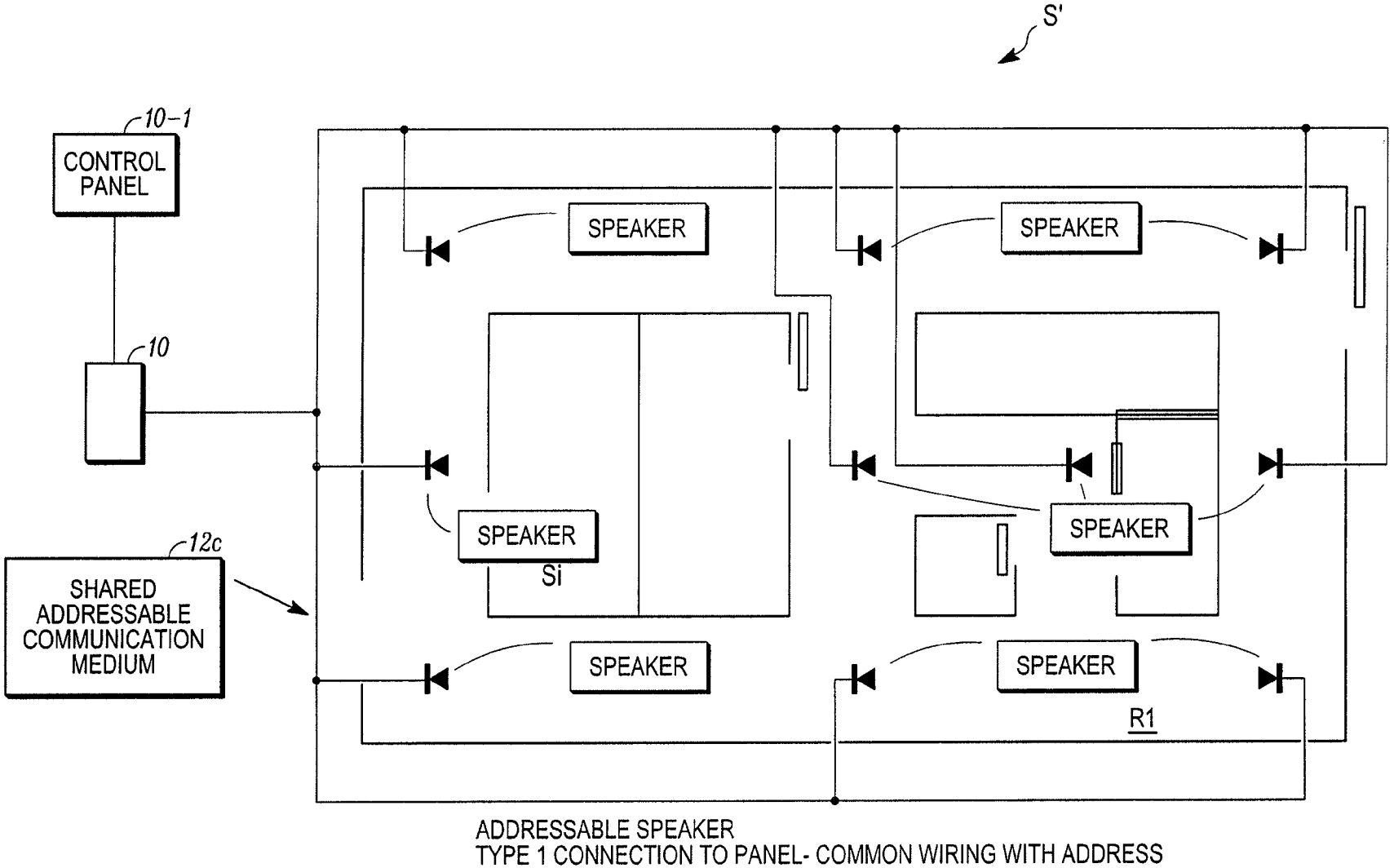
FIG. 4 illustrates a speaker system in accordance with the invention with a first type of connection.

FIG. 4 illustrates the region R1 where the members of a plurality S' are coupled via a shared addressable communication medium 12*c* to the speaker control unit 10. In the configuration of FIG. 4, each of the speakers such as the speaker Si can be addressed by the unit 10 by using the medium 12*c* as appropriate in carrying out the method 100.

Figure 5:
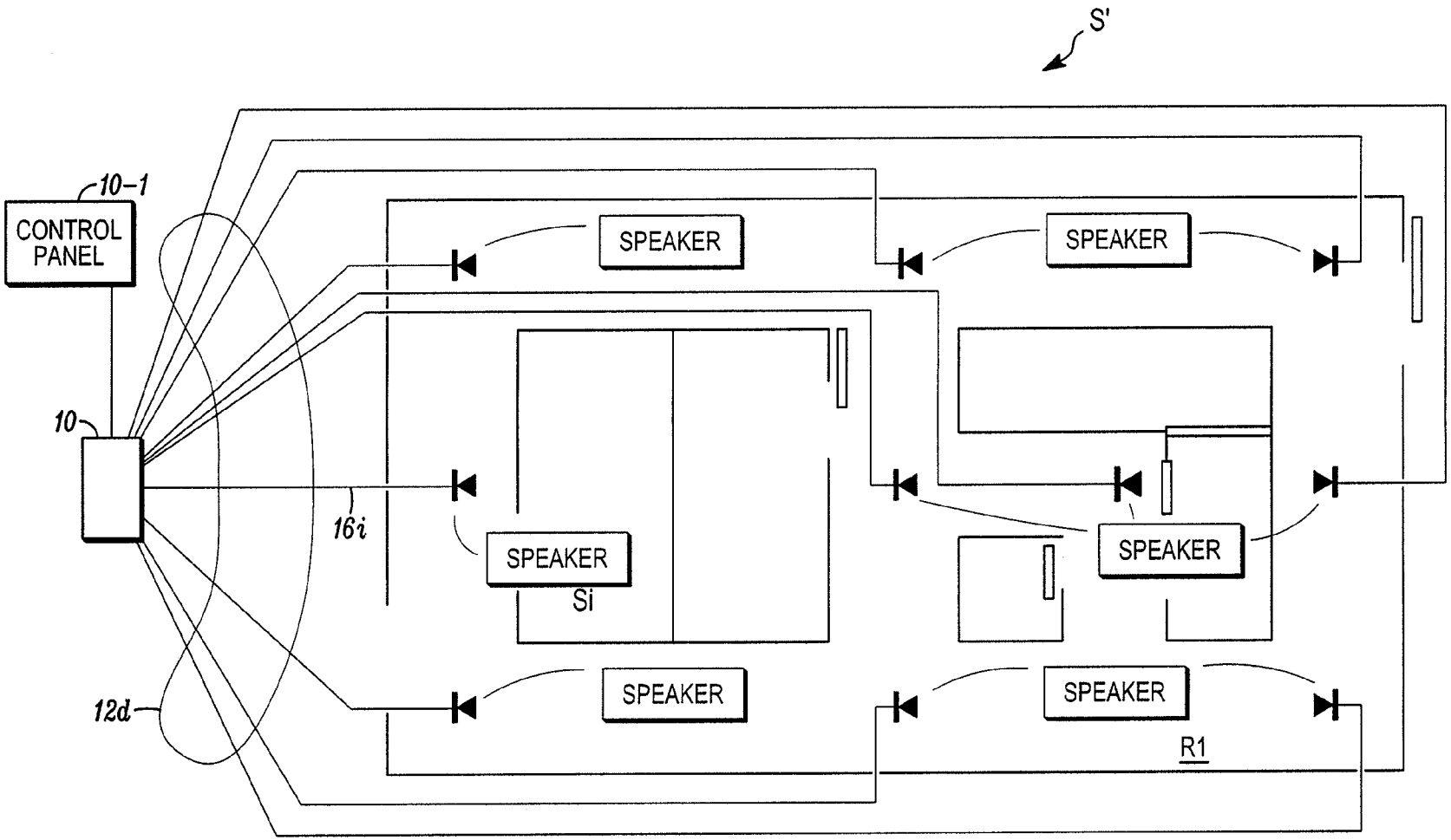
FIG. 5 illustrates a speaker system in accordance with the invention with a second type of connection.

FIG. 5 illustrates the region R1 with the members of the plurality S' coupled to the control unit 10 by a plurality of wired connections 12*d*. Each speaker such as speaker Si is coupled to the unit 10 by an individual wired connection such as connection 16*i*.

It will be understood that the addressable speakers, such as a speaker Si can include a loud speaker or other type of audio output transducer, control circuitry which can include address detection circuitry to detect when the respective speaker Si is being addressed by the control unit 10 as well as circuitry for coupling audio or other messages from the unit 10 to the loud speaker or associated output transducer. Those of skill in the art will understand that such addressable speakers could be implemented in a variety of hardware and circuit configurations without departing from the spirit and scope of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A system comprising:

a plurality of addressable speakers organized as a public address system to inject verbal messages into a region of interest;

a control unit, coupled to the addressable speakers, the control unit including circuitry, responsive to a detected alarm condition, that evaluates a plurality of non-linear escape routes from the alarm condition, a selected non-linear route is audibly communicated via at least some members of the plurality and an audio input transducer coupled to the control unit, wherein the control unit communicates a location of the selected non-linear route by automatically selecting the at least some members of the plurality of speakers one at a time along the selected non-linear route to output verbal messages from the audio input transducer.

2. A system as in claim 1 where the speakers along the selected route emit audible route indicating outputs in a pattern effective for route guidance.

3. A system as in claim 1 where the control unit includes a programmable processor and control software recorded on a computer readable medium.

4. A system as in claim 3 where the software responds to a developing hazardous condition by establishing at least one non-linear route leading away from the condition.

5. A system in claim 4 where the software sequentially activates speakers along the route thereby providing an audibly indicated exit route from the condition.

6. A system as in claim 1 which includes a communications port that receives information as to the detected alarm condition.

7. A system as in claim 6 where the control unit includes a programmable processor and control software recorded on a computer readable medium.

8. A system as in claim 7 where the software defines a plurality of time varying escape routes in response to received information.

9. A system as in claim 8 which includes an ambient condition detection system coupled to the communications port.

10. A method comprising:

establishing a plurality of spaced apart condition detecting locations in a region being monitored;

responsive to information received from at least some of the detecting locations, determining if a predetermined condition is present in the vicinity of at least one location;

responsive to the presence of the predetermined condition, automatically establishing at least one time varying non-linear egress route through the region and away from the at least one location;

providing an audio input transducer to inject audio into the region; and automatically selecting a plurality of speakers located along the established at least one time varying non-linear egress route one at a time to output verbal messages from the audio input transducer.

11. A method as in claim 10 where establishing includes automatically establishing a plurality of different non-linear egress routes.

12. A method as in claim 10 which includes sequentially injecting audio indicia into the region to provide an audible designation of the at least one egress route.

13. A method as in claim 11 which includes injecting a time varying audio pattern into the region to provide an audible designation of the at least one egress route.

14. A method as in claim 13 where the audio pattern is injected one of sequentially, or, non-sequentially into the region, and, which includes automatically altering the at least one egress route over time responsive to variations, over time, of the predetermined condition.

15. A method as in claim 11 which includes automatically altering the at least one egress route over time responsive to variations, over time, of the predetermined condition.

16. A method as in claim 12 where injecting includes sequentially emitting route specifying voice based indicia along the egress route.

17. A method as in claim 13 where injecting includes sequentially emitting route specifying voice based indicia along the egress route.

18. A method as in claim 16 which includes coupling real-time operator generated audio messages to a plurality of sites along the at least one egress route.

19. An apparatus including a recording medium, for recording in a computer readable fashion, software to perform the following when executed by a programmable processor:

receiving information as to the presence of a developing dangerous condition in a region;

responsive to that information, automatically establishing at least one nonlinear egress route away from the condition;

arranging for emission of identifying audio indicia sequentially along the route and an audio input transducer, the audio injectable into the region; and automatically selecting a plurality of speakers located along the established at least one non-linear egress route one at a time to output verbal messages from the audio input transducer.

20. An apparatus as in claim 19 which includes:

automatically altering the at least one egress path, over time, responsive to additional information indicative of a changing condition.

21. An apparatus as in claim 19 which includes:

establishing a plurality of possible egress routes away from the condition; and selecting the at least one non-linear route from the plurality.

22. An apparatus as in claim 21 which includes, selecting a second route, and arranging for simultaneous emission of identifying audio indicia along the second route.

23. A system comprising:

a control unit, an audio input transducer and a plurality of speakers, the control unit including circuitry, responsive to a detected alarm condition, establishes a plurality of possible escape routes which lead away from the alarm condition where at least one of the escape routes is non-linear, wherein the control unit includes circuitry to audibly communicate the at least one route with a series of audio outputs along that route wherein the control unit communicates a location of the selected at least one route by automatically selecting at least some members of the plurality of speakers one at a time along the at least one route to output verbal messages from the audio input transducer.

24. A system as in claim 23 where at least two escape routes, which overlap at least in part, are established, and including circuitry to automatically and audibly communicate both routes simultaneously along the respective routes.

* * * * *